United States Patent [19]

Faust

[11] Patent Number: 4,918,943

[45] Date of Patent: Apr. 24, 1990

[54] CONDENSER

[76] Inventor: Paul A. Faust, 26 Grantwood La., St. Louis, Mo. 63123

[21] Appl. No.: 301,837

[22] Filed: Jan. 26, 1989

[51] Int. Cl.[5] ..... F28D 5/00

[52] U.S. Cl. ..... 62/305; 62/506

[58] Field of Search ..... 62/506, 507, 305; 165/171; 239/102.2

[56] References Cited

U.S. PATENT DOCUMENTS

| | | | |
|---|---|---|---|
| 1,975,945 | 10/1934 | Hopkins | 62/305 X |
| 2,091,159 | 8/1937 | Persons | 62/305 |
| 2,296,997 | 9/1942 | Knoy | 62/506 X |
| 2,611,587 | 9/1952 | Boling | 62/506 X |
| 2,672,024 | 3/1954 | McGrath | 62/305 X |
| 2,958,206 | 11/1960 | Ewing | 62/506 X |
| 3,026,690 | 3/1962 | Deverall | 62/305 |
| 3,137,145 | 6/1964 | Henderson et al. | 62/183 |
| 3,141,308 | 7/1964 | Dart | 62/305 |
| 3,435,631 | 4/1969 | Wood, Jr. | 62/305 |
| 3,488,974 | 1/1970 | Lunde et al. | 62/542 X |
| 3,908,393 | 9/1975 | Eubank | 62/506 X |
| 3,926,008 | 12/1975 | Webber | 62/506 X |
| 3,995,443 | 12/1976 | Iversen | 62/305 |
| 4,010,624 | 3/1977 | McFarlan | 62/159 |
| 4,069,687 | 1/1978 | Larriva | 62/305 |
| 4,576,012 | 3/1986 | Luzenberg | 62/157 |
| 4,702,414 | 10/1987 | Hirabayashi et al. | 239/102.2 X |

*Primary Examiner*—William E. Tapolcai
*Attorney, Agent, or Firm*—Edward J. Hejlek

[57] ABSTRACT

Condenser for compressed refrigerant gas or vapor from a compressor comprising a heat exchanger and evaporative cooling means, with the heat exchanger having two relatively parallel walls each of which has an outer surface, at least one of said walls being heat conductive, an inlet for receiving compressed refrigerant from the compressor, an outlet for delivering cooled compressed refrigerant to an evaporator, and a conduit connecting the inlet and outlet for the flow of compressed refrigerant therethrough, the conduit being between the two walls and parallel to the outer surfaces thereof, and with the evaporative cooling means for cooling the outer surface of the heat conductive wall as compressed refrigerant flows through the conduit.

29 Claims, 3 Drawing Sheets

CONDENSER

BACKGROUND OF THE INVENTION

The present invention is directed to a condenser, and is more particularly directed to an evaporatively cooled condenser useful in residential air-conditioning systems.

Various types of condensers have previously been used as part of residential air-conditioning units, including evaporative condensers. Although evaporative condensers are more efficient than air-cooled condensers when new, they are subject to the build-up of mineral deposits which can significantly reduce their efficiency. Mineral deposits such as lime deposits can be minimized through water-treatment and/or periodic cleaning, but there are costs associated therewith. In view of these additional costs and maintenance, it is commonly believed that residential customers prefer air-cooled condensers.

What is needed, therefore, is a condenser that provides the efficiency of an evaporative condenser but does not require substantially more maintenance than an air-cooled condenser.

SUMMARY OF THE INVENTION

Among the objects of the present invention, therefore, is the provision of a condenser which requires relatively little maintenance, the provision of a condenser which provides greater efficiency than an air-cooled condenser only, the provision of a condenser which is of a size adapted for use as a residential unit, and the provision of a condenser which is relatively low cost and relatively easy to manufacture and assemble.

Briefly, therefore, the present invention is directed to a condenser for compressed refrigerant gas or vapor from a compressor. The condenser comprises a heat exchanger having two substantially parallel walls each of which has an outer surface, with at least one of said walls being heat conductive. The heat exchanger additionally has an inlet for receiving compressed refrigerant from the compressor, and an outlet for delivering cooled compressed refrigerant to an evaporator. A conduit connects the inlet and outlet for the flow of compressed refrigerant therethrough, the conduit being between the two walls and substantially parallel to the outer surfaces of the two walls. The heat exchanger additionally has evaporative cooling means for cooling the outer surface of the heat conductive wall as compressed refrigerant flows through the conduit.

The present invention is additionally directed to a condenser comprising first and second heat exchangers. The first heat exchanger is for the transfer of heat from compressed refrigerant received from a compressor to ambient air. The first heat exchanger has an inlet for receiving compressed refrigerant, an outlet, and a first conduit connecting the first heat exchanger inlet and outlet and means for transferring heat from the compressed refrigerant to ambient air. The second heat exchanger has two substantially parallel walls each of which has an outer surface, at least one of said walls being heat conductive. The second heat exchanger additionally has an inlet for receiving compressed refrigerant from the first heat exchanger outlet, and an outlet for delivering cooled compressed refrigerant to an evaporator. A second heat exchanger conduit connects the second heat exchanger inlet and outlet for the flow of compressed refrigerant therethrough, the second heat exchanger conduit being between the two walls and parallel to the heat conductive outer surface. The second heat exchanger additionally has evaporative cooling means for cooling the outer surface of the heat conductive wall as compressed refrigerant flows through the conduit.

The present invention is further directed to a condensing unit for an air-conditioning system comprising a compressor for compressing refrigerant gas or vapor, a first heat exchanger, a second heat exchanger and evaporative cooling means. The only difference between the condensing unit and the condenser described in the paragraph immediately above is the inclusion of a compressor.

Other objects and features of this invention will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF A PREFERRED EMBODIMENT

Figure 1:
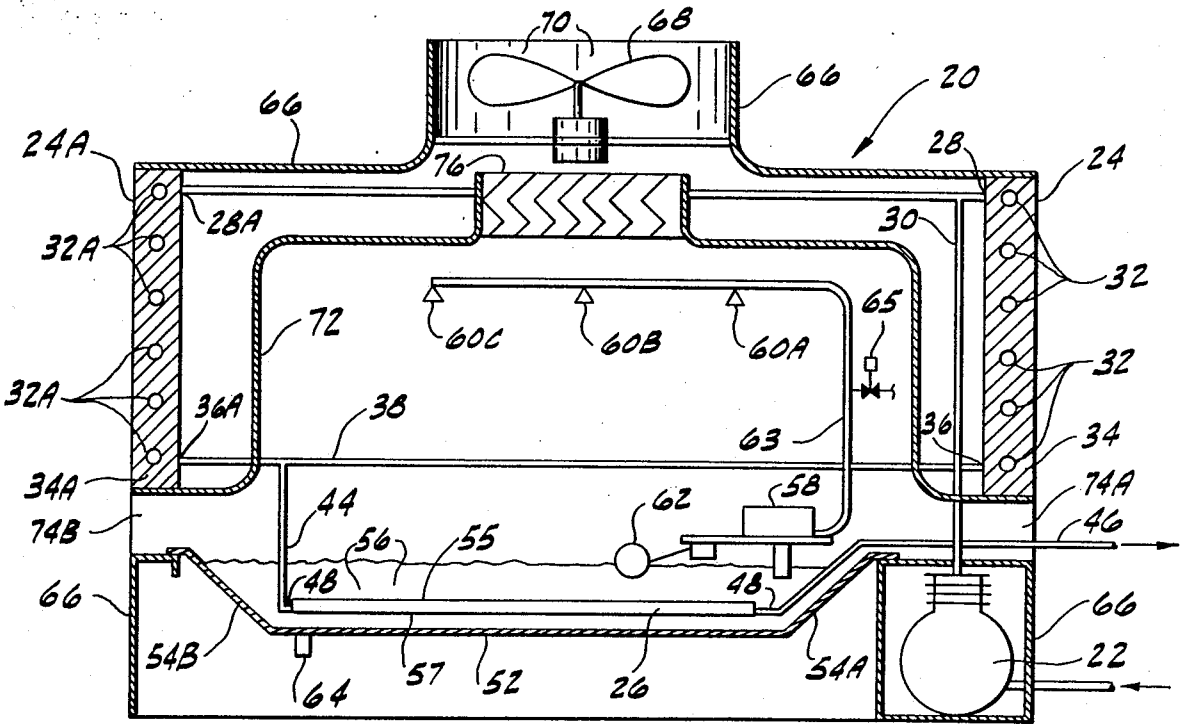
FIG. 1 is a schematic view partly in section of a condensing unit comprising the condenser of the present invention.

A condensing unit constructed according to the principles of this invention for condensing and cooling hot, compressed refrigerant is indicated generally as 20 in FIG. 1. It principally comprises a compressor 22 for compressing the refrigerant gas or vapor, a first heat exchanger consisting of two heat exchange units 24, 24A, and a second heat exchanger 26.

The first heat exchanger units 24, 24A are finned-tube heat exchange units of the type currently being used as a condenser in condensing units of some residential air-conditioning systems. The units have first heat exchanger inlets 28, 28A that are connected by tubing 30 to the compressor 22. The inlets 28, 28A are in fluid communication with first heat exchanger conduits 32, 32A, shown in cross-section in FIG. 1. First heat exchanger conduits 32, 32A are continuous tubes that horizontally traverse from one side of each finned-tube unit to the other side thereof, respectively, curve downward and around and then horizontally traverse back to the other side of the finned tube unit, etc. until the bottom of the unit is reached. Near the bottom of the first heat exchanger units 24, 24A, first heat exchanger conduits 32, 32A terminate at first heat exchanger outlets 36, 36A. The first heat exchanger conduits 32, 32A together with fins 34, 34A that radiate outwardly from the conduits constitute heat exchange means for transferring heat from the compressed refrigerant to ambient air. Tubing 38 is in fluid communication with the first heat exchanger outlets 36, 36A and directs compressed refrigerant that has been cooled by the action of the first heat exchanger 24, 24A to the second heat exchanger 26.

Figure 2:
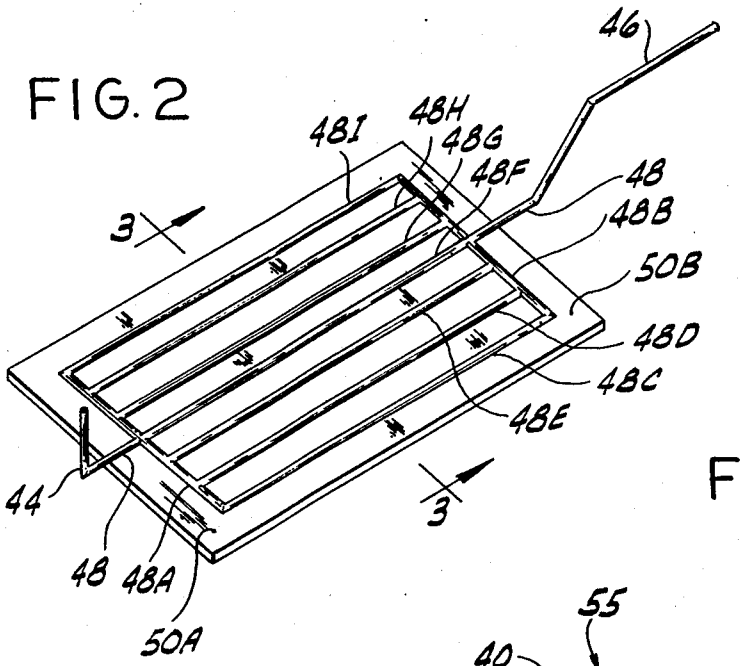
FIG. 2 is a perspective of an evaporatively cooled condenser of the present invention.
Figure 3:
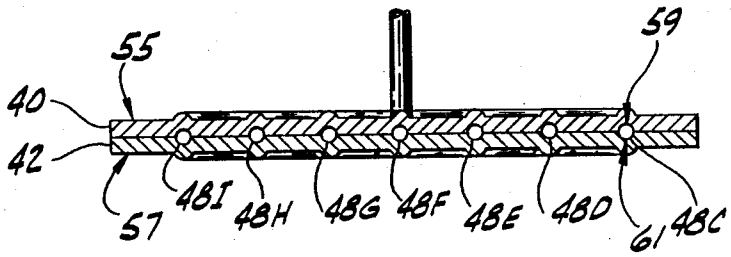
FIG. 3 is a cross-sectional view taken along line 3—3 of FIG. 2 showing channels for the flow of compressed refrigerant through the evaporatively condenser.

Referring to FIGS. 1, 2 and 3, the second heat exchanger 26 has two substantially parallel walls 40, 42, each of which has an outer surface 55, 57, respectively, that is heat conductive. The second heat exchanger additionally has an inlet 44 for receiving compressed refrigerant from the first heat exchanger, and an outlet 46 for delivering cooled compressed refrigerant to an evaporator (not shown). Conduit 48 connects inlet 44 and outlet 46 for the flow of refrigerant therethrough. As shown in FIGS. 2 and 3, the second heat exchanger conduit 48 is between the walls 40, 42 and substantially parallel to the outer surfaces 55, 57. The conduit is defined by an opening between inner surfaces 59, 61 of walls 40, 42, respectively. As also shown in FIGS. 2 and 3, the second heat exchanger conduit 48 has manifolds 48A, 48B with channels 48C–I running therebetween. Essentially, the channels 48C–I of conduit 48 run substantially from one side margin 50A of the walls 40, 42 to another side margin 50B of the walls 40, 42. As shown, the two walls 40, 42 are substantially flat and broad, i.e., the length and width of the two walls are substantially greater than the distance between the outer surfaces 55, 57. Conveniently, the second heat exchanger 26 may be stamped aluminum or other metal.

Referring to FIG. 1, the second heat exchanger 26 additionally has means for evaporative cooling comprising the pan 52, pump 58 and nozzles 60A–C. The second heat exchanger is positioned above pan 52 and within the sloped sidewalls 54A, 54B thereof. The pan is designed to hold a quantity of water 56 such that the outer surfaces 55, 57 of second heat exchanger walls 40, 42, respectively are in contact with water 56. Thus, heat contained by the compressed refrigerant flowing through the second heat exchanger conduit 48 will be transferred through heat conductive walls 40, 42 to water 56.

The temperature of water 56 is maintained near the prevailing wet-bulb temperature by evaporative cooling by means of a pump 58 connected to nozzles 60A–C via pump discharge tubing 63. Water 56 is withdrawn from the pan 52 by the pump 58 and sprayed by nozzles 60A–C which are located above the pan 52. As the sprayed water falls toward the pan, evaporation of a portion of the sprayed water cools the remainder of the sprayed water to a temperature near the prevailing wet bulb temperature. The pump 58 has a float 62 for determining the level of water 56 within the pan. When the level is less than a predetermined level, the float actuates a means (not shown) for adding make-up water to the pan. The pan 52 additionally has a drain 64 for removing the water 56 for cleaning or winterization.

In order to periodically reduce the concentration of scale forming minerals in water 56, drain valve 65 in pump discharge tubing 63 connects the pump 58 to a remote drain or sewer (not shown). Periodically, drain valve 65 is opened (manually or electronically) and water 56 is pumped to the remote drain or sewer, to be replaced by make-up water.

Referring again to FIG. 1, the condensing unit 20 also has housing 66 which forms the exterior walls for the condensing unit and which supports the first heat exchanger units 24, 24A and the pan 52. There is a fan 68 at the top of the unit which causes air to enter the sidewalls of the condenser for cooling and then exit through the top opening 70 of the unit. Partition 72 causes the ambient air to flow through the openings between fins 34, 34A of the first heat exchange units 24, 24A and to enter the side openings 74A, 74B of the condensing unit 20. Ambient air entering through side openings 74A, 74B encounters water spray directed down from nozzles 60A–C and exits the unit through top opening 70 after passing through mist eliminator 76. The effluent or flow out of the mist eliminator should be wasted because of the high concentrations of lime and other scale forming minerals in the water.

Continued operation of the condensing unit 20 without changing the water 56 in pan 52 results in the build-up of mineral deposits upon the outer surfaces 55, 57 of the second heat exchanger. However, the substantially flat, even outer surfaces 55, 57 of the walls 40, 42 of the second heat exchanger makes it possible to acid clean or manually remove such mineral deposits with greater ease than for example would be required to clean a coil of tubing. In order to further facilitate cleaning, pan 52 is preferably removable and partition 72 and pan 52 are preferably constructed of plastic or other acid resistant material.

The outer surfaces 55, 57 of walls 40, 42 of the second heat exchanger may be provided with an extremely thin coating of a polymeric resin resistant to mineral deposits. Such polymeric coatings include, for instance, the product resulting from the polymerization of tetrafluoroethylene, sold under the trademark TEFLON by DuPont.

In order to break the water into even smaller particles, thus assisting and speeding evaporation, ultrasonic transducers may be attached to the spray nozzles 60A–C. The transducers effectively cause a portion of the scale forming minerals to be carried away by ambient air used for evaporative cooling thereby reducing the build-up of mineral deposits on the outer surfaces 55, 57 of walls 40, 42 of the second heat exchanger.

OPERATION

Start-up of the condensing unit 20 of the present invention entails filling the pan 52 with sufficient water to cover the outer surfaces 55, 57 of walls 40, 42 of the second heat exchanger. Upon demand, the compressor 22 begins to compress refrigerant gas or vapor and directs the compressed refrigerant via tubing 30 to the first heat exchanger units 24, 24A where the refrigerant enters the first heat exchanger units through inlets 28, 28A. From inlets 28, 28A, the compressed refrigerant enters conduits 32, 32A and makes six passes horizontally across the first heat exchanger units. After making the six passes across the first heat exchanger units 24, 24A, the compressed refrigerant flows through first heat exchanger outlets 36, 36A.

As the compressed refrigerant is flowing through first heat exchanger conduits 32, 32A, fan 68 is operating to draw air through the openings between fins 34, 34A resulting in the cooling of the compressed refrigerant.

Figure 4:
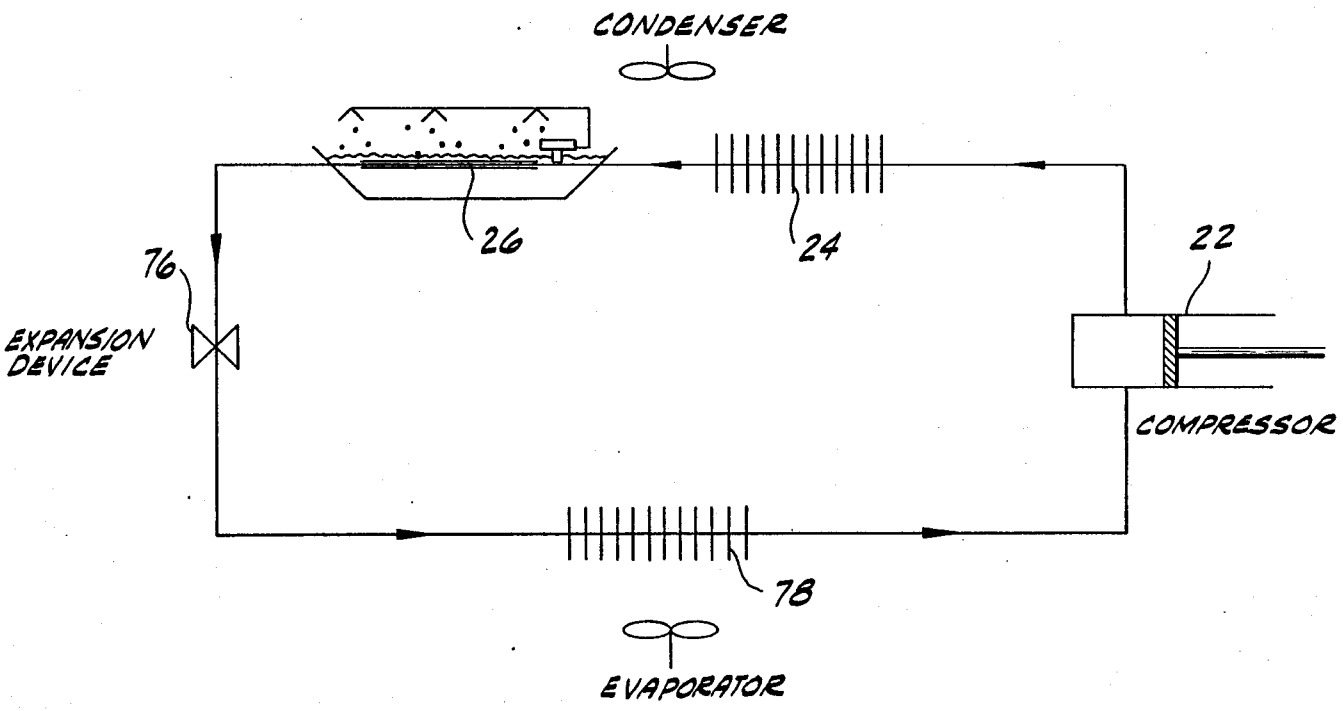
FIG. 4 is a schematic showing the flow of refrigerant through a classical vapor-compression refrigeration cycle with the addition of an evaporative condenser of the present invention.

The partially cooled compressed refrigerant is then directed from the first heat exchanger outlets 36, 36A to the second heat exchanger inlet 44 via tubing 38. The partially cooled refrigerant flows through second heat exchanger inlet 44 and into second heat exchanger conduit 48. In second heat exchanger conduit, the compressed refrigerant encounters manifold 48A which distributes the flow through channels 48C–I and after flowing through those channels, manifold 48B unites the compressed refrigerant flow into a single stream whereupon the compressed refrigerant exits the second heat exchanger via outlet 46. From outlet 46, the compressed refrigerant is directed to an expansion device 76, then to an evaporator 78 and back to the compressor 22, all as shown in schematic in FIG. 4.

As compressed refrigerant is flowing through second heat exchanger conduit 48, the water 56 contacting the outer surfaces 55, 57 of walls 40, 42 of the second heat exchanger is being evaporatively cooled through the action of the pump 58 and nozzles 60A–C. Water 56 is withdrawn from the pan 52 by pump 58 and directed to nozzles 60A–C where it is sprayed in a fine mist back into the direction of the pan. As the mist falls toward the pan, it is evaporatively cooled to near the prevailing wet-bulb temperature. The evaporatively cooled mist then falls into the pan to maintain the temperature of the water in the pan as near as practical to the prevailing wet bulb temperature. Fan 68 causes air to enter side-wall openings 74A, 74B and to encounter the water mist and thereby cause evaporative cooling. To compensate for the loss of water from the pan 52 by evaporation, make-up water is added as necessary with float valve 62 actuating a means for the addition of the make-up water.

In order to periodically reduce the concentration of scale forming minerals in water 56, drain valve 65 in pump discharge tubing 63 connects the pump 58 to a remote drain or sewer (not shown). Periodically, drain valve 65 is opened (manually or electronically) and water 56 is pumped to the remote drain or sewer, to be replaced by make-up water.

Partition 72 serves to prevent mixing of the ambient air used for heat transfer in connection with the first heat exchange units 24, 24A with ambient air used for evaporative cooling of the mist sprayed by nozzles 60A–C. Consequently, partially cooled refrigerant received from the first heat exchange units is further cooled by the transfer of heat from heat from the compressed refrigerant to the water 56 in the pan 52.

The combination of the evaporatively cooled condenser (second heat exchanger 26) of the present invention with a conventional air-cooled heat exchanger is preferred for at least two reasons. First, partial cooling of the compressed refrigerant before it enters the evaporatively cooled heat exchanger lessens the heat transfer demand in that heat exchanger. Consequently, fouling caused by mineral deposits will be less of a factor. Secondly, in the event the evaporatively cooled heat exchanger is not operative because of a failure in the pump, nozzles or pan, the residential customer can still operate his or her air-conditioner; while it may be significantly more expensive to cool the compressed refrigerant exclusively by means of the air-cooled heat exchanger, this is preferable to doing without until the unit can be serviced.

Although it is preferred to use the evaporatively cooled condenser of the present invention in combination with a conventional air-cooled heat exchanger, it should be noted that the invention is not so limited. It is contemplated that the evaporatively cooled condenser of the present invention may be used in the absence of such an air-cooled heat exchanger to cool compressed refrigerant gases or vapors.

Additionally, it should be noted that the evaporative cooling means should not be narrowly construed to consist of a pan 52, pump 58 and nozzles 60A–C. It is contemplated that evaporative cooling of the heat conductive walls 40, 42 may be effected by spraying water directly onto the outer surfaces 55, 57 of walls 40, 42 and allowing the water to evaporate from the outer surface of the walls 40, 42.

In view of the above, it will be seen that the several objects of the invention are achieved.

As various changes could be made in the above apparatus without departing from the scope of the invention, it is intended that all matter contained in the above description shall be interpreted as illustrative and not in a limiting sense.

What is claimed is:

1. A condenser for compressed refrigerant gas or vapor from a compressor comprising a first heat exchanger for the transfer of heat from compressed refrigerant received from the compressor to ambient air, the first heat exchanger having an inlet for receiving compressed refrigerant, an outlet, and a first conduit connecting said first heat exchanger inlet and outlet and means for transferring heat from the first conduit to ambient air, a second heat exchanger having two substantially parallel walls each of which has an outer surface with at least one of said walls being heat conductive, an inlet for receiving compressed refrigerant from the first heat exchanger outlet, an outlet for delivering cooled compressed refrigerant to an evaporator, and a second heat exchanger conduit connecting the second heat exchanger inlet and outlet for the flow of compressed refrigerant therethrough, the second heat exchanger conduit being between the two walls and substantially parallel to the outer surfaces of the two walls, evaporative cooling means for cooling the outer surface of the heat conductive wall of the second heat exchanger as compressed refrigerant flows through the second heat exchanger conduit, and a partition for preventing mixing of ambient air used for heat exchange with the first heat exchanger and air used for evaporative cooling of the second heat exchanger.

2. A condenser as set forth in claim 1 wherein the heat conductive wall has side margins and the conduit makes a plurality of passes from one side margin of the heat conductive wall to another side margin thereof.

3. A condenser as set forth in claim 1 wherein the outer surface of the heat conductive wall has a thin coating of a polymeric resin that is resistant to the build-up of mineral deposits.

4. A condenser as set forth in claim 1 wherein the walls of the heat exchanger are substantially flat.

5. A condenser as set forth in claim 1 wherein the length and width of the two walls of the heat exchanger are substantially greater than the distance between the two walls.

6. A condenser as set forth in claim 1 wherein the evaporative cooling means comprises a pan for holding a quantity of water, a pump for pumping water from the pan, a nozzle connected to the pump for spraying water removed from the pan by the pump, and a fan for causing air to contact and evaporatively cool water sprayed by the nozzles.

7. A condenser as set forth in claim 6 wherein the heat exchanger is positioned within the pan and beneath the nozzles.

8. A condenser as set forth in claim 6 wherein the nozzles are connected to an ultrasonic transducer.

9. A condenser as set forth in claim 6 comprising means for pumping water contained in the pan to a remote drain or sewer.

10. A condenser for compressed refrigerant gas or vapor from a compressor comprising a first heat exchanger for the transfer of heat from compressed refrigerant received from the compressor to ambient air, the first heat exchanger having an inlet for receiving compressed refrigerant, an outlet, and a first conduit connecting said first heat exchanger inlet and outlet and means for transferring heat from the first conduit to ambient air, a second heat exchanger having two substantially parallel walls each of which has an outer surface with at least one of said walls being heat conductive, an inlet for receiving compressed refrigerant from the first heat exchanger outlet, an outlet for delivering cooled compressed refrigerant to an evaporator, and a second heat exchanger conduit connecting the second heat exchanger inlet and outlet for the flow of compressed refrigerant therethrough, the second heat exchanger conduit being between the two walls and substantially parallel to the outer surfaces of the two walls, evaporative cooling means for cooling the outer surface of the heat conductive wall of the second heat exchanger as compressed refrigerant flows through the second heat exchanger conduit, and means for preventing the evaporative cooling means from contacting the ambient air that is cooling the first heat exchanger.

11. A condenser as set forth in claim 10 wherein the heat conductive wall has side margins and the second heat exchanger conduit makes a plurality of passes from one side margin of the heat conductive wall to another side margin thereof.

12. A condenser as set forth in claim 10 wherein the outer surface of the heat conductive wall has a thin coating of a polymeric resin that is resistant to the build-up of mineral deposits.

13. A condenser as set forth in claim 10 wherein the walls of the second heat exchanger are substantially flat.

14. A condenser as set forth in claim 10 wherein the length and width of the two walls of the second heat exchanger are substantially greater than the distance between the two walls.

15. A condenser as set forth in claim 10 wherein the means for preventing comprises a partition for preventing mixing of ambient air used for heat exchange with the first heat exchanger and air used for evaporative cooling in connection with the second heat exchanger.

16. A condenser as set forth in claim 10 wherein the evaporative cooling means comprises a pan for holding a quantity of water, a pump for pumping water from the pan, a nozzle connected to the pump for spraying water removed from the pan by the pump, and a fan for causing air to contact and evaporatively cool water sprayed by the nozzles.

17. A condenser as set forth in claim 16 wherein the second heat exchanger is positioned within the pan and beneath the nozzles.

18. A condenser as set forth in claim 16 wherein the nozzles are connected to an ultrasonic transducer.

19. A condenser as set forth in claim 16 comprising a means for pumping water contained in the pan to a remote drain or sewer.

20. A condensing unit for an air-conditioning system comprising a compressor for compressing refrigerant gas or vapor, a first heat exchanger for the transfer of heat from compressed refrigerant received from the compressor to ambient air, the first heat exchanger having an inlet for receiving compressed refrigerant, an outlet, and a first conduit connecting said first heat exchanger inlet and outlet and means for transferring heat from the first conduit to ambient air, a second heat exchanger having two substantially parallel walls each of which has an outer surface with at least one of said walls being heat conductive, an inlet for receiving compressed from the first heat exchanger outlet, an outlet for delivering cooled compressed refrigerant to an evaporator, and a second heat exchanger conduit connecting the second heat exchanger inlet and outlet for the flow of compressed refrigerant therethrough, the second heat exchanger conduit being between the two walls and substantially parallel to the outer surfaces of the two walls, evaporative cooling means for cooling the outer surface of the heat conductive wall of the second heat exchanger as compressed refrigerant flows through the second heat exchanger conduit, and means for preventing the evaporative cooling means from contacting the ambient air that is cooling the first heat exchanger.

21. A condensing unit as set forth in claim 20 wherein the heat conductive wall has side margins and the conduit makes a plurality of passes from one side margin of the heat conductive wall to another side margin thereof.

22. A condensing unit as set forth in claim 20 wherein the outer surface of the heat conductive wall has a thin coating of a polymeric resin that is resistant to the build-up of mineral deposits.

23. A condensing unit as set forth in claim 20 wherein the walls of the heat exchanger are substantially flat.

24. A condensing unit as set forth in claim 20 wherein the length and width of the two walls of the heat exchanger are substantially greater than the distance between the two walls.

25. A condensing unit as set forth in claim 20 wherein the means for preventing comprises a partition for preventing mixing of ambient air used for heat exchange with the first heat exchanger and air used for evaporative cooling in connection with the second heat exchanger.

26. A condensing unit as set forth in claim 20 wherein the evaporative cooling means comprises a pan for holding a quantity of water, a pump for pumping water from the pan, a nozzle connected to the pump for spraying water removed from the pan by the pump, and a fan for causing air to contact and evaporatively cool water sprayed by the nozzles.

27. A condensing unit as set forth in claim 26 wherein the heat exchanger is positioned within the pan and beneath the nozzles.

28. A condensing unit as set forth in claim 26 wherein the nozzles are connected to an ultrasonic transducer.

29. A condensing unit as set forth in claim 26 comprising means for pumping water contained in the pan to a remote drain or sewer.

* * * * *